United States Patent [19]

Guss, III

[11] Patent Number: 5,062,807

[45] Date of Patent: Nov. 5, 1991

[54] LIGHTED ELECTRICAL CONNECTOR PERMITTING MULTI DIRECTIONAL VIEWING

[75] Inventor: Robert J. Guss, III, Glen Ellyn, Ill.

[73] Assignee: Woodhead Industries, Inc., Northbrook, Ill.

[21] Appl. No.: 600,916

[22] Filed: Oct. 22, 1990

[51] Int. Cl.[5] ..... H01K 3/00

[52] U.S. Cl. ..... 439/490; 439/736; 340/815.15

[58] Field of Search ..... 340/815.15, 815.16, 340/815.17, 815.18, 815.19, 815.2, 815.21, 638, 639; 439/488–491, 893, 620, 651–655, 736

[56] References Cited

U.S. PATENT DOCUMENTS

| | | | |
|---|---|---|---|
| 3,383,588 | 5/1968 | Stoll et al. | 439/490 |
| 3,500,293 | 3/1970 | Cocco | 439/490 |
| 4,350,407 | 9/1982 | Tong | 439/490 |
| 4,500,160 | 2/1985 | Bertsch | 439/651 |
| 4,671,597 | 6/1987 | Grill | 439/490 |
| 4,758,175 | 7/1988 | Didier et al. | 439/651 |
| 4,767,359 | 8/1988 | Martell | 439/654 |

*Primary Examiner*—David L. Pirlot
*Attorney, Agent, or Firm*—Emrich & Dithmar

[57] ABSTRACT

A lighted, quick-disconnect, right-angle molded electrical connector for connecting a control device or a sensor to a load includes a lens of light-transmissive material, covers a "power available" light source and a "power applied" light source and is arranged to have external viewing surfaces so that the indicators can readily be seen from substantially any normal viewing direction.

10 Claims, 3 Drawing Sheets

LIGHTED ELECTRICAL CONNECTOR PERMITTING MULTI DIRECTIONAL VIEWING

BACKGROUND OF THE INVENTION

This invention relates to quick-disconnect connector assemblies, and more particularly to a condition-indicating, lighted, molded electrical connector assembly for connecting a control or monitoring device to a load.

There are many applications in which quick-disconnect type connectors are used to establish connections between electrical power lines and a load, typically by interfacing sensors and other control components with the power lines and load. For example, in industrial applications, such connectors may be used for wiring control circuit applications, such as pilot-actuated hydraulic valves or conveyor system controls, or for controllers using sensing devices such as proximity switches or pilot optic sensors. The quick-disconnect type connectors provide reliable, error-free connection of multi-wire systems in a fraction of the time required to hardwire the circuit or to establish a semi-permanent connection as by soldering or using screws and terminal blocks.

It is commonplace to have connectors with two, three, four or even more poles. For example, in the case of a sensor, such as a proximity switch, being connected by means of a multi-wire cable to a controller, two wires may be used to connect the sensor in circuit with a source of electrical power.

Typically, the quick-disconnect connector is used to connect a control device, such as a proximity switch, in circuit with electrical power lines and the load to control electrical power to the load. In such application, it is generally desirable to indicate the condition of the circuit, such as when power is available for application to the load. In addition, it may be desired to indicate when power is being applied to the load—i.e., the control device or switch is turned "on". Connectors which provide these functions are known as "lighted connectors". Lighted connectors which are presently available include one or more neon indicating lamps (or light-emitting diodes) mounted within a connector housing which has internal terminating elements to which are connected the electrical wires of the cable. Neon lamps and LEDs are considered equivalent for present purposes, and reference to one implies the other as well. Generically, they may be referred to as "indicators" or "indicating devices". The housing has windows or apertures therethrough and the neon lamps are located adjacent to the windows to be visible from the exterior of the connector. In use, the neon lamps are lit to indicate circuit conditions, such as "power available" or "power applied", as described above.

Although these "lighted connectors" provide the desired visual indications of power and load status, connectors of this type have required making the connector with apertures to permit viewing of the indicator. Also during assembly, the indicator must be mounted adjacent to the apertures through which they are exposed. Moreover, because the on/off condition of the indicator is provided only on the one side of the connector, it may be difficult for a user to quickly determine one or both of the conditions being indicated.

SUMMARY OF THE INVENTION

The present invention provides a molded connector of the type described for making a right-angle connection and having a light-transmissive lens located in the upper, rear portion of a connector body having generally planar side surfaces. The lens extends along contiguous portions of the top, rear and side surfaces of the connector body so that the visual indication (i.e. "power available" and/or "power applied") may readily be observed from substantially all normal viewing directions.

The invention consists of certain novel features and structural details hereinafter fully described, illustrated in the accompanying drawings, and particularly pointed out in the appended claims, it being understood that various changes in the details may be made without departing from the spirit of the invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF PREFERRED EMBODIMENTS

Figure 1:
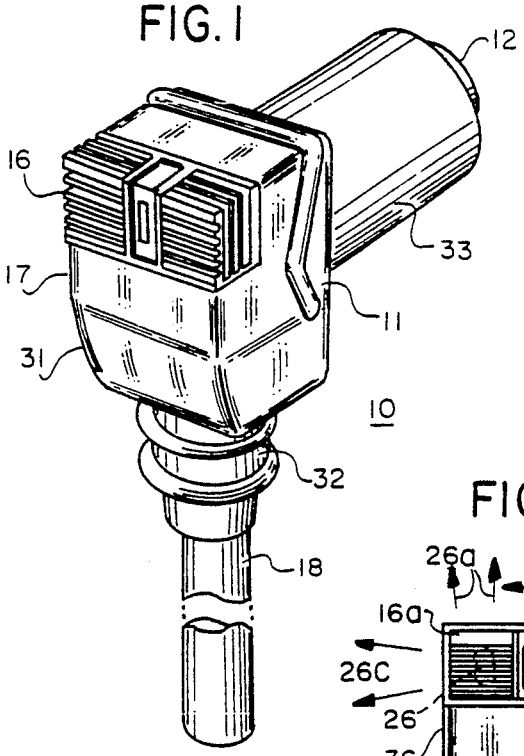
FIG. 1 is an upper rear perspective view of a quick-disconnect connector assembly incorporating the present invention.
Figure 2:
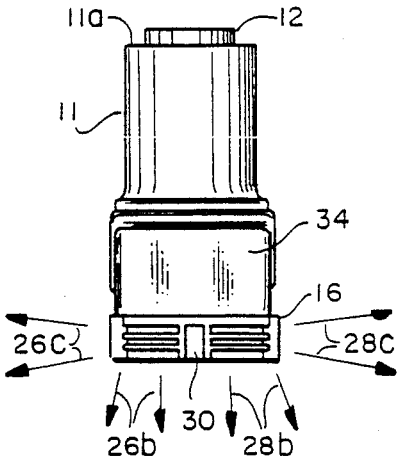
FIG. 2 is a plan view of the connector assembly of FIG. 1.

Referring to FIGS. 1–4 and 7 of the drawings, a quick-disconnect, molded lighted connector assembly is indicated generally at 10. The connector assembly 10 includes a connector body 11, an insert/contact assembly 12, an indicating circuit 14, a lens 16, and a multi-conductor cable 18. The connector body 11 receives and encapsulates the insert/contact assembly 12, the indicating circuit 14, and a terminating portion 18*a* of the cable 18. The lens 16 is molded into the upper rear corner of a junction portion 17 of the connector body 11 and transmits light produced by indicating devices of the indicating circuit 14 to the exterior of the lens 16 for indicating continuity conditions.

Figure 3:
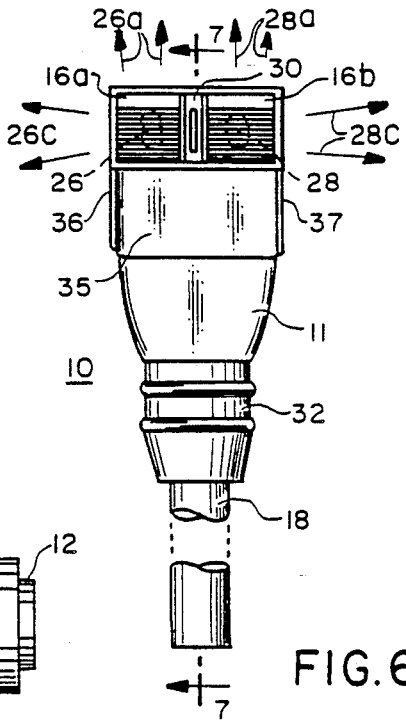
FIG. 3 is a rear elevation view of the connector assembly of FIG. 1.
Figure 4:
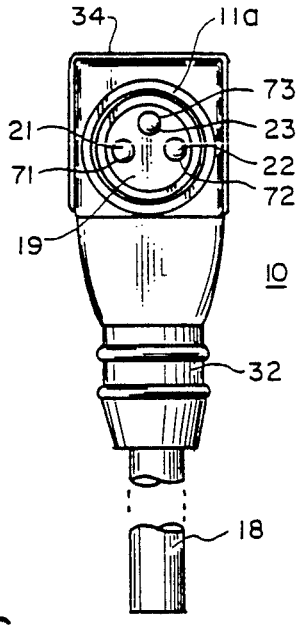
FIG. 4 is a front elevation view of the connector assembly of FIG. 1.
Figure 6:
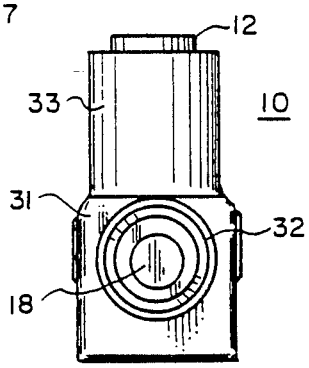
FIG. 6 is a bottom view of the connector assembly of FIG. 1.
Figure 7:
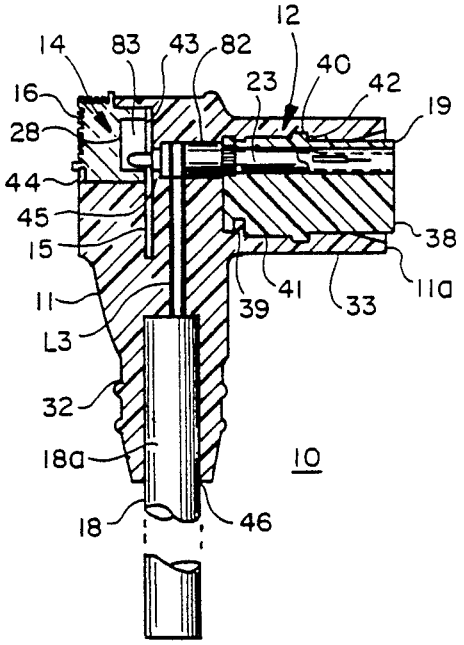
FIG. 7 is a sectional view of the connector assembly taken along the lines 7—7 of FIG. 3.

In the illustrated embodiment, the connector assembly 10 is a three-pole, right-angle, molded connector; and the multi-conductor cable 18 includes three conductors, one conductor L3 of which is shown in FIG. 7. The length of the multi-conductor cable may be one foot or greater. The insert/contact assembly 12 includes a connector insert 19 and three socket contacts or terminals 21, 22 and 23 which are mounted in longitudinally extending bores or channels in the insert 19, and terminate adjacent the mouth 11*a* (FIG. 7) of a cylindrical portion 33 of connector body 11 which defines a receptacle for the insert 12. The indicating circuit 14 includes two indicating devices, such as light-emitting diodes (LEDs) 26 and 28 which are mounted on a printed circuit board 15 (see FIG. 8) and are located adjacent the front of lens 16, with diode 26 near the left side of the connector assembly (when viewed from the rear) 10 and diode 28 near the right side of the connector assembly, as shown in FIG. 3.

The connector assembly 10 may be connected with power conductors, a load, and a functional device, such as a control device or sensor; such that LED 28, for example, is energized whenever power is available, and the other LED 26 is also energized when power is applied to the load. The two LEDs 26 and 28 may generate different colored light (green and yellow, for example), so as to provide unique visual indications for different conditions (i.e. "power available" and "power applied").

In accordance with the present invention, the lens 16 is made of a material which is translucent or transparent (i.e. light transmissive), and is constructed and arranged on the connector body and adjacent to the two LEDs 26, 28 to produce visual indications which may be observed from substantially all normal-viewing directions (i.e. back, top and both sides). For example, with reference to FIGS. 2 and 3, light produced by LED 26 is transmitted upwardly, rearwardly and to both sides as indicated by arrows 26*a*, 26*b* and 26*c*, respectively. Light produced by LED 28, which is located behind lens portion 16*b*, is transmitted upwardly, forwardly and to both sides as indicated by arrows 28*a*, 28*b* and 28*c*, respectively. It will be appreciated that the forward portion of the cylindrical portion 33 of the connector is normally coupled to a device or sensor housed in a cabinet or machine, so that the normal viewing position of an observer is from the top, rear or side of the connector, such as in FIG. 1. Thus, an observer is quickly alerted as to "power available" and "power on" conditions, by merely glancing in the direction of the connector assembly 10 and noting whether or not it is lit, and the color or position of the light.

Considering the connector assembly 10 in more detail, with reference to FIGS. 1–7, connector assembly 10 is a right angle connector. The junction portion 17 of connector body 11 has a generally rectangular, vertically extending body portion 31 which terminates at its lower end in a generally cylindrical portion 32, which couples to one end 18*a* of the cable 18. The cylindrical portion 33 houses the insert/contact assembly 12 of the connector body 11 as will be described. The conductors of cable 18 are connected to the indicating circuit 14 inside the body portion 31. The connector body 11 is a one-piece element molded around the insert 12, one end 18*a* of the cable 18, the indicating circuit 14 and a mounting portion of the lens 16. The connector body 11 is made of polyvinyl chloride elastomer or other suitable moldable material and is normally opaque.

As shown in FIGS. 2–5, the junction portion 17 of connector assembly 10 has a generally rectangular appearance, including generally planar top and rear surfaces 34 and 35, as well as side surfaces 36 and 37.

The molded connector body 11 has an annular cylindrical cavity 38 formed in cylindrical portion 33 which receives the connector insert 19. Inwardly extending annular projection 39 and annular groove 40 formed on the inner surface of portion 33 of the connector body 11 cooperate with annular groove 41 and annular projection 42 on the outer surface of the connector insert 19 to retain it in place in the cavity 38. The connector body 11 has further projections 43 and 44 which extend from side to side along the front and top surfaces to secure the lens 16 to the connector body 11. Vertically extending projections, such as projection 45 shown in FIG. 7, extend between projections 43 and 44. Projections 43, 44 and 45 define an opening or window to the interior of the connector body 11, which opening is closed by the lens 16. The cylindrical portion 32 of the connector body 11 defines a cylindrical bore 46 which receives the terminating end 18*a* of the cable 18.

Figure 5:
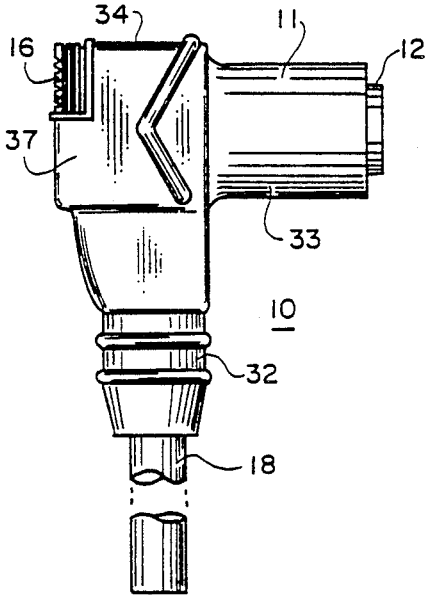
FIG. 5 is a right side elevation view of the connector assembly of FIG. 1.
Figure 5A:
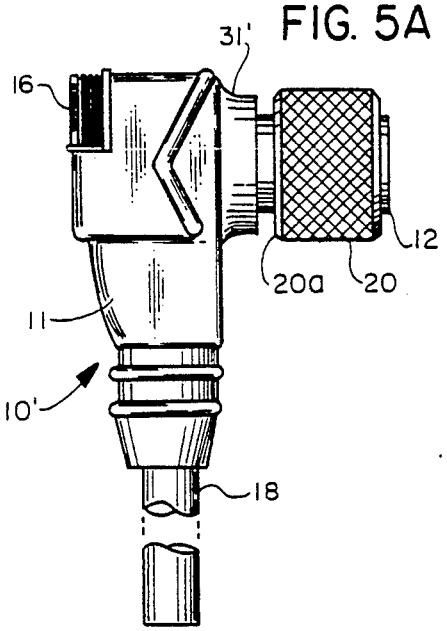
FIG. 5A is a side elevational view of a further embodiment for a quick-disconnect connector assembly provided by the present invention.

The connector assembly 10 is maintained coupled by friction to the plug (not shown) of a functional device with which it is used. Alternatively, connector assembly 10′, shown in FIG. 5A, includes a threaded coupling nut 20 to positively secure the connector assembly 10′ to a functional device with which it is used. Connector assembly 10′ is the same as connector assembly 10 except for the addition of the coupling nut 20 and the foreshortening of the cylindrical portion 33, given reference numeral 31′ in FIG. 5A, to maintain exposed the annular projection 42 of connector insert 19 which serves as a stop to maintain the coupling nut 20 on the connector assembly 10′ by interference with inwardly directed annular flange 20*a* of the coupling nut 20.

Figure 8:
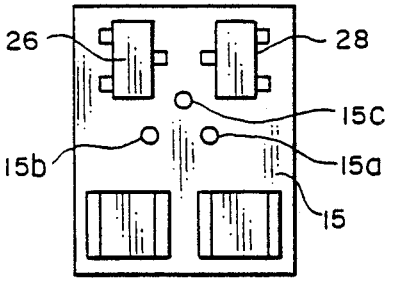
FIG. 8 is a plan view of a printed circuit board of the indicating circuit of the connector assembly.
Figure 9:
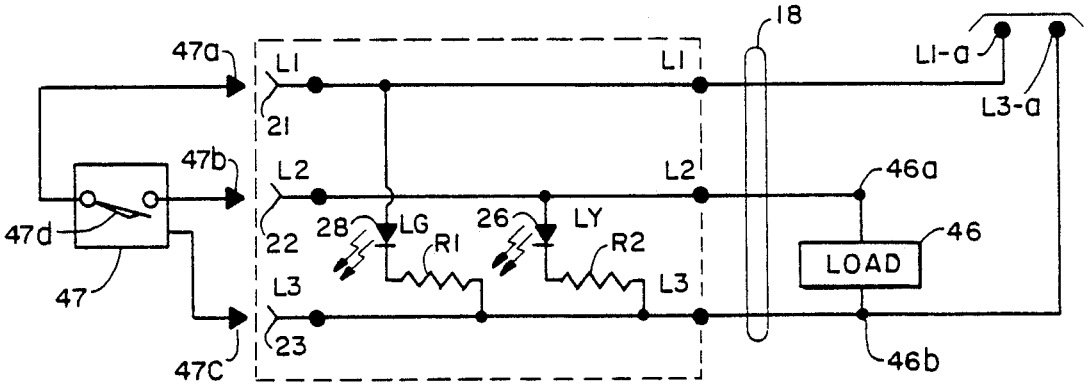
FIG. 9 is a schematic circuit diagram of the quick-disconnect connector assembly, illustrating an application for connecting a control device to a load for applying power to the load.
Figure 10:
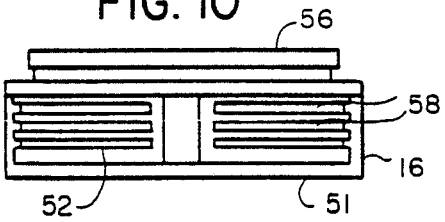
FIG. 10 is an enlarged plan view of the lens of the connector assembly of FIG. 1.

Referring to FIGS. 8 and 9, the indicating circuit 14 includes printed circuit board 15, LEDs 26 and 28, and resistors R1 and R2. For example, the LEDs 26 and 28 and resistors R1 and R2 are mounted on the printed circuit 15 and interconnected by printed circuit wiring (not shown) to form the circuit illustrated within the dashed line 14 in FIG. 9. The printed circuit board 15 has terminal receiving apertures 15*a*, 15*b* and 15*c* which pass through conductive lands (not shown).

Conductors L1, L2, and L3 of the multi-conductor cable 18 connect to a source of AC or DC power at terminals L1-a and L3-a, and to a load 46. The connector assembly 10 is removably connectable to a functional device 47, such as a control device or sensor, which has male prongs 47*a*, 47*b* and 47*c* which are receivable by the socket contacts, such as contacts 21, 22 and 23 of the connector assembly 10.

The LED 28 is connected in series with current-limiting resistor R1 between conductors L1 and L3. Light-emitting diode 26 is connected in series with current-limiting resistor R2 between conductor L2 and conductor L3. Conductor L1 is connected to the power hot line at terminal L1-a, conductor L3 is connected to the power neutral or return line at terminal L3-a and conductor L3 is connected to one terminal 46*a* of a load 46 the other terminal 46*b* of which is connected to the neutral or return line L3.

The control device 47 is illustrated as a switch having switch arm 47*d* connected between male connecting elements such as blades or prongs 47*a* and 47*b* of a plug (not shown) which are receivable within female socket contacts 21 and 22 of the connector assembly 10.

LED 28 is energized whenever power is available between conductors L1 and L3. LED 26 is energized whenever switch 47 is operated so that its switch arm 47*d* completes a circuit path between conductors L1 and L2, thereby extending power to the load terminal 46*a*, the other load terminal 46*b* being connected directly to the return power conductor L3.

As shown best in FIG. 7, the printed circuit board 15 is mounted vertically within the connector body 11 with the LED facing rearwardly and located at the forward surface of the lens 16.

Figure 11:
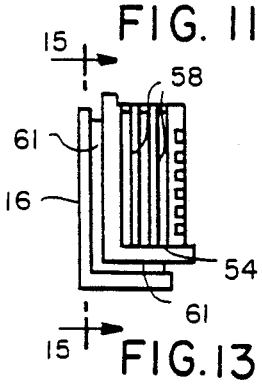
FIG. 11 is a left side elevation view of the lens of FIG. 10.
Figure 12:
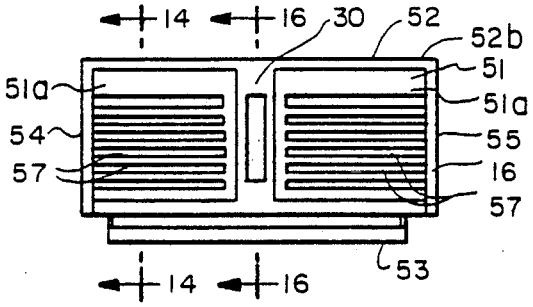
FIG. 12 is a rear elevation view of the lens of FIG. 10.
Figure 13:
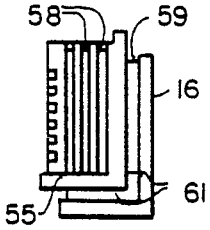
FIG. 13 is a right side elevation view of the lens of FIG. 10.

Referring to FIGS. 10–16, the lens 16 is a one piece element, preferably molded of a clear transparent material, such as material commercially available under the trademark ZYTEL 330. The lens 16 is generally rectangular in shape and has a rear surface 51, a top surface 52, a bottom surface 53, side or end surfaces 54 and 55 and a front 56. The rear surface 51 has a plurality of parallel linear grooves 57 which extend inwardly from its outer edge toward its middle portion from each side 54 and 55 thereof. Similarly, the top surface 52 has a plurality of parallel extending linear grooves 58 which extend from the center toward both sides 54 and 55 and also extend downwardly along the sides as shown in FIGS. 11 and 13, for example. The grooves 57 and 58 in the front, top and side surfaces of the lens define baffle portions which enhance the light output of the lens 16 by scattering or dispersing the incident light. In severe use environments, where dirt or grime may tend to collect, the dispersion grooves 57, 58 of the lens 16 may be formed on the inner surface of the lens.

Figure 14:
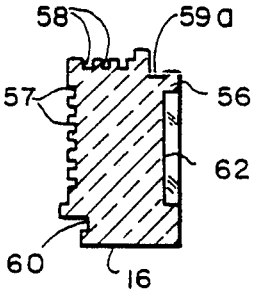
FIG. 14 is a sectional view taken along the lines 14—14 of FIG. 12.
Figure 15:
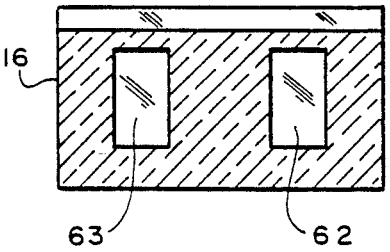
FIG. 15 is a sectional view taken along the lines 15—15 of FIG. 11.
Figure 16:
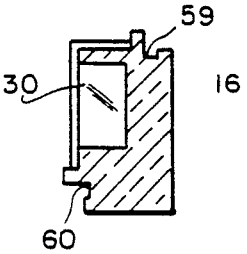
FIG. 16 is a sectional view taken along the lines 16—16 of FIG. 12.
Figure 17:
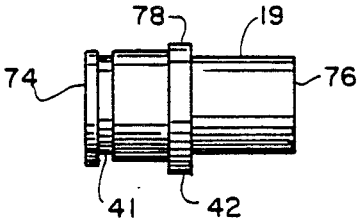
FIG. 17 is a side elevation view of a connector insert for the connector assembly of FIG. 1.

As shown in FIGS. 14 and 16, the lens 16 has a notch 59 in its top surface 52 and a notch 60 in its rear surface 51 which are communicated with one another by way of channels 61 (FIGS. 11 and 13) formed in the side surfaces 54 and 55 of the lens, as shown in FIGS. 11 and 13. These notches and channels receive molded portions of the connector body 11, such as portions 43 and 44 of the connector body 11, to secure the lens 16 to the connector body 11.

Referring to FIGS. 3 and 14–16, the lens 16 has a pair of chambers 62 and 63 molded therein which locate the light-emitting diodes 26 and 28, respectively. A central portion 30 of the lens 16 divides the lens 16 in a left portion 16*a* and right portion 16*b*, as in the illustrated embodiment, but this is not necessary to the invention.

Referring to FIGS. 3, 7, 17 and 18, the connector insert 19 is a generally cylindrical element formed of a suitable insulating material such as nylon. The connector insert 19 defines three contact receiving bores or channels 71, 72 and 73, such as channel 73 shown in FIG. 18, each of which extends from one end 74 of the insert member to a point 75 just short of the other end 76 of the insert member, there being a bore 77 of reduced diameter, the surfaces of which taper or flare outwardly from the inner bore 71 to end surface 76 to guide the prongs of the functional device 47 (FIG. 9) into socket contacts 21–23. The connector insert 19 has an annular projection 42 near its midpoint which extends radially outwardly. The connector insert 19 has a reduced diameter portion from annular projection 42 towards its end 76. The connector insert 19 has an annular groove 41 in its outer surface near its other end 74. The annular projection 42 is received in the annular groove 40 (FIG. 7) of the connector body 11. The annular groove 41 in the connector insert 19 receives the annular projection 39 (FIG. 7) of the connector body 11.

Figure 19:
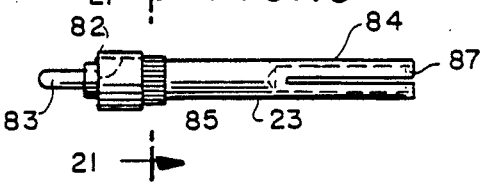
FIG. 19 is an enlarged side elevational view of a socket contact of the connector assembly of FIG. 1.
Figure 20:
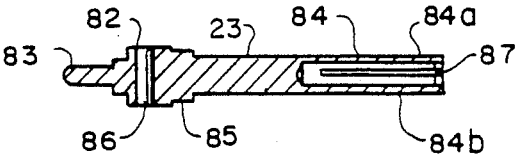
FIG. 20 is a sectional view of the socket contact of FIG. 19.
Figure 21:
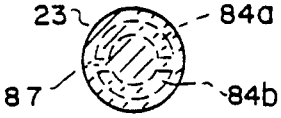
FIG. 21 is a sectional view taken along the lines 21—21 of FIG. 19.

Referring now to FIGS. 19–21, each socket contact, such as socket contact 23 shown in FIGS. 19–21 is a generally cylindrical element having a head portion 82, a prong 83, and a bifurcated shank 84, there being a knurled annular portion 85 at the base of the shank 84 adjacent to the head portion 82. The head portion 82 has a transverse bore 86 therethrough. The shank 84 has a slot 87 therethrough defining the bifurcated portions 84*a* and 84*b*.

Figure 18:
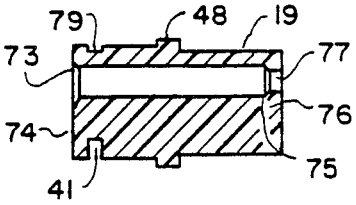
FIG. 18 is a sectional view of the connector insert of FIG. 17.

Referring to FIGS. 7, 18 and 19, the outer diameter of the knurled portion 85 of each socket contact, such as socket contact 23, is slightly greater than the diameter of the corresponding throughbore 73 of the contact insert 19 to provide an interference fit between the socket contact 23 and the inner surface of the throughbore 73 of the contact insert 19 when assembled as shown in FIG. 7 with its shank 84 extending into the throughbore. The length of the shank portion 84 corresponds to the length of the throughbore in the contact insert 19 such that the bifurcated end terminates at the opening 75 at end 76 of the contact insert 19. The bifurcated end portions 84*a* and 84*b* are bent slightly inwardly so as to provide a positive contact between the prongs of the plug of the associated functional device 47 (FIG. 9).

The diameter of the prong 83 is dimensioned to correspond to the diameter of the apertures 15*a*, 15*b*, 15*c* in the printed circuit board 15 (FIG. 8). The diameter of the transverse bore 86 in the head portion 82 is dimensioned to receive the stripped ends of the conductors 18*a* of the multi-conductor cable 18, such as for the end of conductor L3 which is received in bore 86 of socket contact 23, as shown in FIG. 7.

Briefly, in assembling the connector assembly 10, the socket contacts 21–23 are positioned in respective chambers 71–73 in the connector insert 19 with the knurled portions, such as knurled portion 85 for socket contact 23, providing an interference fit between the socket contact and the inner surface of the contact insert 19. Then, the printed circuit board 15 (FIG. 8) with the light-emitting diodes and resistors mounted thereon is assembled with the insert/contact assembly 12, with the prongs, such as prong 83 for socket contact 23, extending through the apertures, such as aperture 15*c*, in the printed circuit board 15. Then, the conductors L1–L3 of the cable 18 are inserted through the transverse bores, such as bore 86 in socket contact 23. The electrical connections are then made using solder, for example. The lens 16 is positioned on the printed circuit board 15, indexed with light-emitting diodes 26 and 28 located in chambers 62 and 63. The lens 16 is secured to the upper surface of the printed circuit board 15 in a suitable manner such as by adhesive and/or mounting posts or mounting feet. The thus assembled insert/contact assembly 12, indicating circuit 14 and lens 16 are placed in a suitable mold (not shown) and the connector body 11 is molded around the thus assembled components to form the completed connector assembly 10.

In use, with reference to FIGS. 1, 3, 8 and 9, conductors L1 and L3 are hardwired to the power input and return lines, at contacts L1-a and L3-a, respectively. Conductor L2 is connected to terminal 46*a* of the load 46. The other terminal 46*b* of the load 46 is hardwired to the return line.

A functional device, such as proximity switch 47, having male-type prongs, is plugged into the female receptacle defined by socket contacts 21–23 of the connector assembly 10 and held in place by friction.

When an AC or DC voltage is applied to power input terminal L1-a and L3-a, the voltage appears across conductors L1 and L3, energizing LED 28. When LED 28 is energized, green light is transmitted through the top, rear and both sides of lens 16 to indicate that power is available for the control device 47.

When the control device 47 is operated, a circuit path is completed through the switch 47 between conductors L1 and L2 of the connector assembly, completing a circuit path for the load 46 between power input terminals L1-a and L3-a. Accordingly, the load 46 is energized. The voltage appearing between conductors L3 and L2, energizes LED 26. When LED 26 is energized, yellow light is transmitted through the top, rear and both sides of lens 16, indicating that the load 46 is energized. Thus, if the connector is mounted such that the observer can see only one side of the connector, he nevertheless can see two distinctly different colors of light emanating from the near side of the lens if both LEDs are lit.

While in the exemplary embodiment, the connector assembly 10 is described as having an indicating circuit 14 which includes a pair of indicating devices which provide separate indications of "power on" and "power available" conditions, persons skilled in the art will appreciate that a connector assembly may be provided that does not include indicator 26 and resistor R2 so that the indicating circuit indicates only a "power available" condition. Alternatively, a connector assembly may be provided that does not include indicator 28 and resistor R1 so that the indicating circuit 14 indicates only a "power on" condition.

Further, whereas the illustrated embodiment of the lens includes a central portion 30 separating the two recesses receiving the light sources, that portion may be omitted, if desired, or replaced by an opaque material, while continuing to practice the principles of the invention.

Moreover, although for purposes of illustration the connector assembly is described as being a three pole device and including a three-conductor cable, it is apparent that the connector assembly may have fewer or more poles and correspondingly fewer or more conductors and may be adapted to receive one or more control devices as well as one or more sensors, depending upon the application for the connector assembly.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. A quick-disconnect connector assembly for completing an electrical circuit to connect a functional device to a load, and for indicating a continuity condition for the electrical circuit, said connector assembly comprising:

connector body means including a lens portion, said connector body means having a rear surface, a top surface and first and second side surfaces;

contact means including a plurality of contact elements located within said connector body means;

a multi-conductor cable including a plurality of electrical conductors, a terminating portion of said cable extending into said connector body means, at least first and second conductors of said plurality of conductors being electrically connected to first and second ones of said contact elements within said connector body means;

indicating circuit means within said connector body means and including first and second light sources located adjacent to said lens portion, said first light source being energized to indicate a first continuity condition when power is connected to said electrical circuit and said second light source being energized to indicate a second continuity condition when power is applied to the load; said first light source emitting light in a first frequency band and said second light source emitting light in a second frequency band, said lens portion having a forward surface, an upper surface and first and second side surfaces and being constructed and arranged to transmit light in said first frequency band at least through portions of its forward and upper surfaces and through said first side surface and to transmit light in said second frequency band at least through portions of its forward and upper surfaces and through said second side surface of said lens; said indicating circuit means being electrically connected to said contact means within said connector body means to enable one of said light sources to be energized whenever the continuity condition associated therewith is provided, said lens portion being of a light transmissive material and defining a plurality of light transmitting surfaces which are oriented in at least two different respective directions, whereby whenever one of said continuity conditions is provided, light produced by said light source associated with said condition is transmitted through said lens portion in different directions.

2. The connector assembly of claim 1, wherein said light source of said indicating circuit means is so connected to conductors of said multi-conductor cable as to indicate that power is available for application to the load.

3. The connector assembly of claim 1, wherein said light source of said indicating circuit means is so connected to conductors of said multi-conductor cable as to indicate that power is being applied to the load.

4. The connector assembly of claim 1, wherein said functional device is a switch operable to connect electrical power to said load, said first light source being energized whenever power is connected to said electrical circuit and said second light source being energized whenever power is applied to the load.

5. The connector assembly of claim 1, wherein said functional device is a monitoring device for indicating a condition of the load, said first light source being energized whenever power is available for said monitoring device, and said second light source being energized whenever power is applied to the load.

6. The connector assembly of claim 1, wherein said lens portion defines a plurality of generally planar surfaces, including first, second and third surfaces which are oriented in such a way that light produced by said light source is visible from at least three of said surfaces of said connector body means.

7. The connector assembly of claim 6, wherein said lens portion is generally rectangular in shape, said first, second and third surfaces extending mutually perpendicular to one another defining, respectively, an upper surface, a rear surface and a first side surface for said lens portion, said lens portion including a further generally planar surface extending perpendicular to said first and second surfaces, defining a second side surface for said lens portion.

8. The connector assembly of claim 7 wherein said lens portion has a forward surface recessed to define a housing for said light source.

9. The connector assembly of claim 1, wherein said connector body means comprises a lens having a mounting portion and a connector body molded around said contact means, said indicating circuit means, said mounting portion of said lens and said terminating portion of said multiconductor cable.

10. The connector assembly of claim 9, wherein said molded connector body is an opaque polyvinyl chloride elastomer.

* * * * *